US006561161B2

(12) United States Patent
Geyer

(10) Patent No.: US 6,561,161 B2
(45) Date of Patent: May 13, 2003

(54) THROTTLE VALVE CONFIGURATION HAVING AN EMERGENCY AIR DEVICE

(75) Inventor: Dirk Geyer, Maxhütte (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/217,175

(22) Filed: Aug. 12, 2002

(65) Prior Publication Data

US 2003/0019471 A1 Jan. 30, 2003

Related U.S. Application Data

(63) Continuation of application No. PCT/DE00/04467, filed on Dec. 14, 2000.

(30) Foreign Application Priority Data

Feb. 10, 2000 (DE) ..... 100 05 786

(51) Int. Cl.[7] ..... F02D 9/08
(52) U.S. Cl. ..... 123/337; 123/396
(58) Field of Search ..... 123/337, 396, 123/319, 327

(56) References Cited

U.S. PATENT DOCUMENTS 2,093,961 A 9/1937 Ericson
2,102,846 A 12/1937 Hunt
4,668,440 A * 5/1987 Sausner ..... 261/65
4,827,884 A 5/1989 Cook
5,975,051 A 11/1999 Yamada et al.
6,003,554 A 12/1999 Magdelyns et al.

FOREIGN PATENT DOCUMENTS

| | | |
|---|---|---|
| DE | 38 01 084 A1 | 12/1988 |
| DE | 38 24 775 A1 | 1/1990 |
| DE | 199 33 722 A1 | 1/2000 |
| JP | 61 014 458 | 1/1986 |
| JP | 06 088 540 | 3/1994 |

OTHER PUBLICATIONS

Author not listed: "Dual Valve Air Control Valve Throttle Body", XP–000824697, No. 409, May 1998, p. 571.

* cited by examiner

*Primary Examiner*—Bibhu Mohanty
(74) *Attorney, Agent, or Firm*—Laurence A. Greenberg; Werner H. Stemer; Gregory L. Mayback

(57) ABSTRACT

A throttle valve configuration having an emergency air device in the form of an additional valve which normally closes off an emergency air opening in the throttle valve, and when the drive fails, can be rotated relative to the throttle valve in order to release the emergency air opening so that the internal combustion engine receives sufficient air to travel to a garage or a similar service center.

11 Claims, 1 Drawing Sheet

THROTTLE VALVE CONFIGURATION HAVING AN EMERGENCY AIR DEVICE

CROSS-REFERENCE TO RELATED APPLICATION

This application is a continuation of copending International Application No. PCT/DE00/04467, filed Dec. 14, 2000, which designated the United States and was not published in English.

BACKGROUND OF THE INVENTION

Field of the Invention

The present invention relates to a throttle valve configuration having an emergency air device for the intake system of an internal combustion engine.

Such an emergency air device has the purpose, when the drive of the throttle valve drive fails, of moving the throttle valve into an emergency air position in which the internal combustion engine is supplied with sufficient air to travel to a garage or to another location (limp home). In the prior art (see for example U.S. Pat. No. 5,975,051) such an emergency air device is formed, for example, from two external springs which act in opposite directions and associated stops which ensure that, when the drive fails, the throttle valve is moved into a position (emergency air position) which lies between the idling position and the open position. The disadvantage here is that the drive of the throttle valve must operate counter to the force of this additional spring system. For this reason, the drive must be configured larger than necessary in order to achieve a sufficient adjustment speed. It is even more critical that the emergency operating position results in a discontinuity in the adjustment path and in the adjustment movement of the throttle valve, which requires a non-linear pilot control with corresponding control expenditure.

SUMMARY OF THE INVENTION

It is accordingly an object of the invention to provide a throttle valve configuration which overcomes the above-mentioned disadvantages of the prior art apparatus of this general type.

In particular, it is an object of the invention to provide a throttle valve configuration having an emergency air device that requires only the smallest possible drive force and permits linear pilot control of the throttle valve.

With the foregoing and other objects in view there is provided, in accordance with the invention, a throttle valve configuration having an emergency air device for an intake system of an internal combustion engine having an intake duct with a wall. The throttle valve configuration includes: a throttle valve and an additional valve rotatable about a common axis in the intake duct of the internal combustion engine; a restoring spring for providing a force; an additional spring for providing a force between the throttle valve and the additional valve; a drive providing a force for commonly adjusting the throttle valve and the additional valve in an opening direction counter to the force of the restoring spring; and an emergency air opening penetrating the throttle valve. The additional valve is capable of rotating relative to the throttle valve about a predefined emergency air release angle such that when the drive fails, the restoring spring moves the additional valve, counter to the force of the additional spring, out of an emergency air shut-off position in which the additional valve closes off the emergency air opening and into an emergency air release position in which the additional valve releases the emergency air opening so that the internal combustion engine can be supplied with sufficient internal combustion air enabling emergency operation.

In accordance with an added feature of the invention, there is provided, a first drive connection connecting the drive to the additional valve; and a second drive connection connecting the restoring spring to the additional valve. The additional valve transmits the force of the drive and the force of the restoring spring to the throttle valve.

In accordance with an additional feature of the invention, the throttle valve, the additional valve and the additional spring are configured such that the force of the drive is transmitted to the throttle valve by a direct abutment between the additional valve and the throttle valve; and the additional spring transmits the force of the restoring spring to the throttle valve via the additional spring.

In accordance with another feature of the invention, the force of the restoring spring is greater than the force of the additional spring.

In accordance with a further feature of the invention, when the drive fails, the throttle valve is pressed against a fixed stop by the restoring spring via the additional valve and the additional spring, after which the restoring spring moves the additional valve into the emergency air release position counter to the force of the additional spring.

In accordance with a further added feature of the invention, concentric shafts rotatably mount the throttle valve and the additional valve in the wall of the intake duct.

In accordance with a further additional feature of the invention, the additional valve is embodied as a double-armed lever having a first lever arm and a second lever arm. The first lever arm is embodied as a valve part that closes off the emergency air opening. The second lever arm is inclined with respect to the valve part by an angle that corresponds to the emergency air release angle.

In accordance with yet an added feature of the invention, there is provided, a first sensor for sensing the angle of rotation of the throttle valve.

In accordance with yet an additional feature of the invention, there is provided, a second sensor for sensing the angle of rotation of the additional valve.

In accordance with yet another feature of the invention, there is provided, a device for sensing the emergency air release angle by forming a difference between the angle of rotation of the throttle valve and the angle of rotation of the additional valve.

In the throttle valve configuration, the throttle valve is provided with an emergency air opening that is normally closed by the additional valve. If the drive fails, the restoring spring moves the additional valve counter to the force of the additional spring that acts between the two valves, and into the emergency air release position in which the additional valve releases the emergency air opening. The emergency air opening is dimensioned in such a way that, despite the fact that the throttle valve is closed, the internal combustion engine is supplied with sufficient air to permit emergency operation of the vehicle.

Given the normal operation of the throttle valve configuration, the throttle valve and the additional valve are moved together by the drive and no force has to be overcome other than the force of the restoring spring that is present in any case. For this reason, the drive does not need to have larger dimensions than is necessary to operate a throttle valve without an emergency air device. In addition, there is no discontinuity in the adjustment path of the throttle valve configuration so that linear pilot control of the throttle valve configuration is made possible. The controller that is assigned to the throttle valve configuration therefore operates significantly less critically than in the prior art.

Other features which are considered as characteristic for the invention are set forth in the appended claims.

Although the invention is illustrated and described herein as embodied in a throttle valve configuration having an emergency air device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
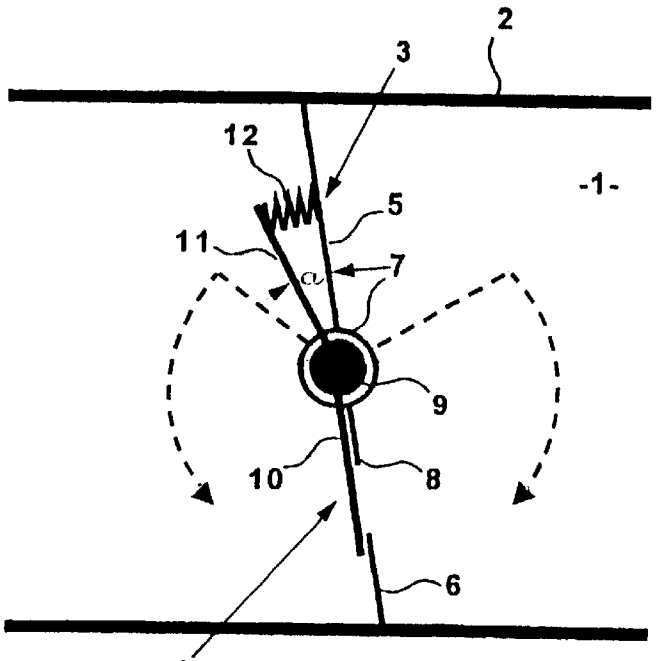
FIG. 1 shows a schematic longitudinal sectional view of a throttle valve configuration.

Referring now to the figures of the drawing in detail and first, particularly, to FIG. 1 thereof, there is shown a schematic view of part of an intake duct 1 through which combustion air is fed to an internal combustion engine (not shown). The intake duct 1, which is delimited by a wall 2, contains a throttle valve configuration in the form of a throttle valve 3 and an additional valve 4.

The throttle valve 3 which is composed of two valve halves 5 and 6 is mounted so as to be rotatable about an axis A by using a hollow shaft 7 that is composed of two hollow shaft stubs located in the wall 2 of the intake duct 1. An emergency air opening 8, which is normally closed off by the additional valve 4, as explained in more detail below, is formed in the valve half 6 of the throttle valve 3.

The additional valve 4 can also rotate about the axis A. For this purpose, it has a shaft 9 which is rotatably mounted in the hollow shaft stubs of the hollow shaft 7 of the throttle valve 3. The additional valve 4 is embodied as a two-armed lever with a lever arm 10 in the form of a valve part and a lever arm 11 lying opposite. The lever arm 10 and the lever arm 11 of the additional valve 4 are, as can be seen in FIG. 1, arranged at an angle with respect to one another so that the additional valve 4 can be adjusted relative to the throttle valve 3 by a predefined emergency air release angle $\alpha$. An additional spring 12 is arranged between the lever arm 11 of the additional valve 4 and the valve half 5 of the throttle valve 3. The additional spring 12 presses the additional valve 4 relative to the throttle valve 3 into an emergency air shut-off position (FIG. 1) in which the valve part (lever arm 10) of the additional valve 4 closes off the emergency air opening 8.

Figure 2:
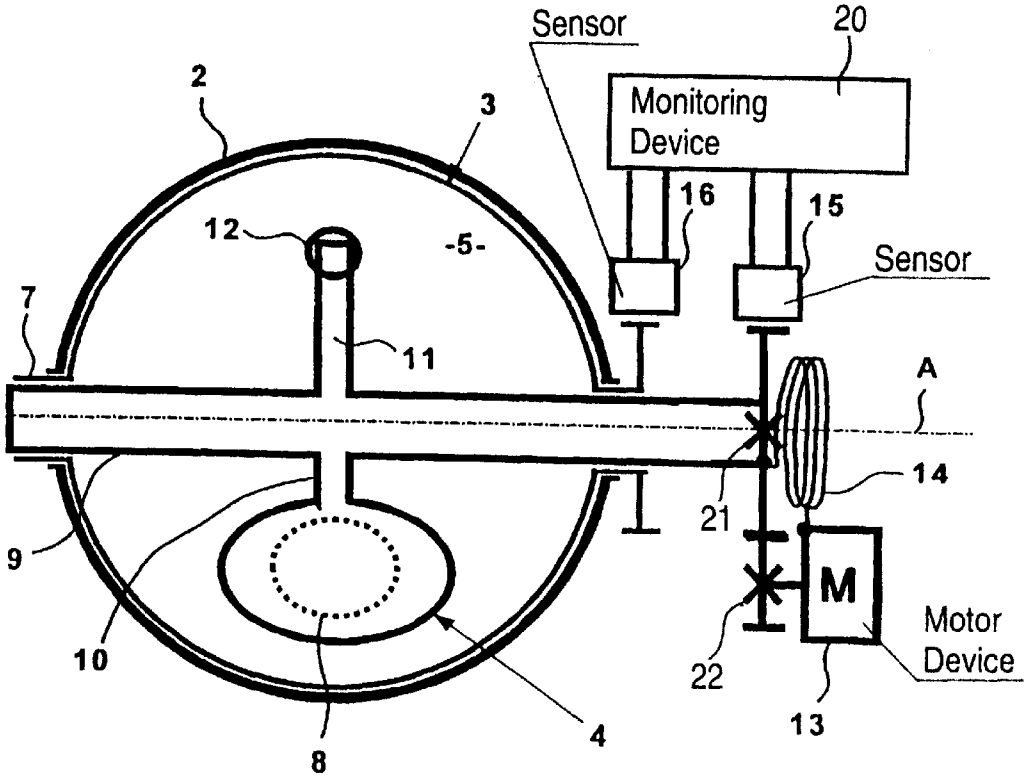
FIG. 2 shows a cross-sectional view of the throttle valve configuration of FIG. 1.

In order to adjust the valve configuration, a motor drive 13 is provided which has a drive connection 22, indicated schematically in FIG. 2, to the shaft 9 of the additional valve 4. The drive 3 operates counter to the effect of a restoring spring 14, which also has a drive connection 21 to the additional valve 4 in order to prestress the throttle valve configuration in the closing direction.

The method of operation of the valve configuration which has been described hitherto is as follows: when the throttle valve configuration is operating normally, the restoring force, which is exerted on the additional valve 4 by the restoring spring 14, is transmitted via the additional spring 12 to the throttle valve 3. As a result of this, the throttle valve 3 is pressed in the clockwise direction (in FIG. 1) into its idling position, which is predefined by the drive 13. The additional spring 12 holds the additional valve 4 here in the emergency air shut-off position (illustrated in FIG. 1) in which the valve part (lever arm 10) of the additional valve 4 closes off the emergency air opening 8 of the throttle valve 3. In order to adjust the throttle valve 3 in the opening direction (counterclockwise direction in FIG. 1), the drive 13 exerts, counter to the force of the restoring spring 14, a corresponding torque on the additional valve 4 which also moves along the throttle valve 3 in the opening direction by direct abutment of the lever arm 10 against the valve half 6.

The additional valve 4 continues to be held here in its emergency air shut-off position by the additional spring 12.

If the drive 13 fails, the emergency air device formed by the additional valve 3 and the emergency air opening 8 operate as follows: when the drive 13 no longer exerts any torque, the restoring spring 14 moves the throttle valve 3 in the closing direction (clockwise direction in FIG. 1) via the additional valve 4 and the additional spring 12 until the throttle valve 3 strikes against the wall 2 of the intake duct 1 or another fixed stop. As the force of the restoring spring 14 is greater than the force of the additional spring 12, the restoring spring 14 moves the additional valve 4, accompanied by compression of the additional spring 12, until the emergency air opening 8 is released by the additional valve 4.

The additional opening 8 is dimensioned in such a way that sufficient combustion air is fed to the internal combustion engine through the emergency air opening 8 to permit emergency operation of the internal combustion engine to enable one to travel to a garage or the like. As soon as the drive 13 is operationally capable again, the throttle valve 3 can be activated again in the fashion described above.

As indicated in FIG. 2, a sensor 15 for sensing the angle of rotation of the additional valve 3 is assigned to the shaft 9 of the additional valve 3. In the same way, the shaft 7 of the throttle valve 3 is assigned a sensor 16 for sensing the angle of rotation of the throttle valve 3. As the angle of rotation of the additional valve 4 is equal to the angle of rotation of the throttle valve 3 plus the angle $\alpha$, the angle $\alpha$ can be determined by forming differences between the signals of the two sensors 15 and 16. This permits the emergency air relief angle to be monitored. A monitoring device 20 is used for sensing the angle ($\alpha$) by forming a difference between the angle of rotation of the throttle valve 3 and the angle of rotation of the additional valve 4.

I claim:

1. A throttle valve configuration having an emergency air device for an intake system of an internal combustion engine having an intake duct with a wall, the throttle valve configuration comprising:

a throttle valve and an additional valve rotatable about a common axis in the intake duct of the internal combustion engine;

a restoring spring for providing a force;

an additional spring for providing a force between said throttle valve and said additional valve;

a drive providing a force for commonly adjusting said throttle valve and said additional valve in an opening direction counter to the force of said restoring spring; and an emergency air opening penetrating said throttle valve;

said additional valve being capable of rotating relative to said throttle valve about a predefined emergency air release angle such that when said drive fails, said restoring spring moves said additional valve, counter to the force of said additional spring, out of an emergency air shut-off position in which said additional valve closes off said emergency air opening and into an emergency air release position in which said additional valve releases said emergency air opening so that the internal combustion engine can be supplied with sufficient internal combustion air enabling emergency operation.

2. The throttle valve configuration according to claim 1, comprising:

a first drive connection connecting said drive to said additional valve; and a second drive connection connecting said restoring spring to said additional valve;

said additional valve transmitting the force of said drive and the force of said restoring spring to said throttle valve.

3. The throttle valve configuration according to claim 2, wherein:

said throttle valve, said additional valve and said additional spring are configured such that the force of said drive is transmitted to said throttle valve by a direct abutment between said additional valve and said throttle valve; and said additional spring transmits the force of said restoring spring to said throttle valve via said additional spring.

4. The throttle valve configuration according to claim 1, wherein: the force of said restoring spring is greater than the force of said additional spring.

5. The throttle valve configuration according to claim 4, comprising:

a fixed stop;

when said drive fails, said throttle valve being pressed against said fixed stop by said restoring spring via said additional valve and said additional spring, after which said restoring spring moves said additional valve into the emergency air release position counter to the force of said additional spring.

6. The throttle valve configuration according to claim 1, comprising:

concentric shafts rotatably mounting said throttle valve and said additional valve in the wall of the intake duct.

7. The throttle valve configuration according to claim 1, wherein:

said additional valve is embodied as a double-armed lever having a first lever arm and a second lever arm;

said first lever arm is embodied as a valve part that closes off the emergency air opening; and said second lever arm is inclined with respect to said valve part by an angle that corresponds to the emergency air release angle.

8. The throttle valve configuration according to claim 1, comprising:

a first sensor;

said throttle valve being at an angle of rotation; and said first sensor for sensing the angle of rotation of said throttle valve.

9. The throttle valve configuration according to claim 8, comprising:

a second sensor;

said additional valve being at an angle of rotation; and said second sensor for sensing the angle of rotation of said additional valve.

10. The throttle valve configuration according to claim 9, comprising:

a device for sensing the emergency air release angle by forming a difference between the angle of rotation of said throttle valve and the angle of rotation of said additional valve.

11. The throttle valve configuration according to claim 1, comprising:

a second sensor;

said additional valve being at an angle of rotation; and said second sensor for sensing the angle of rotation of said additional valve.

* * * * *